United States Patent [19]

Mabuchi

[11] 4,044,245

[45] Aug. 23, 1977

[54] PORTABLE, MULTI-PURPOSE, RECHARGEABLE CIGARETTE LIGHTER

[75] Inventor: Kenichi Mabuchi, Tokyo, Japan

[73] Assignee: Mabuchi Motor Co. Ltd., Tokyo, Japan

[21] Appl. No.: 596,808

[22] Filed: July 17, 1975

Related U.S. Application Data

[62] Division of Ser. No. 413,764, Nov. 8, 1973, Pat. No. 3,934,302.

[30] Foreign Application Priority Data

Nov. 14, 1972 Japan ..... 47-114183
Dec. 12, 1972 Japan ..... 47-124497

[51] Int. Cl.[2] ..... F21V 33/00
[52] U.S. Cl. ..... 240/6.4 CL; 240/10.6 CH
[58] Field of Search ..... 240/2 CL, 6.4 CL, 10.6 R, 240/10.6 CH, 10.65, 10.66, 10.68; 219/220, 267, 268, 269

[56] References Cited

U.S. PATENT DOCUMENTS

| | | | |
|---|---|---|---|
| 2,066,028 | 12/1936 | Britsch | 240/6.4 CL |
| 2,075,883 | 4/1937 | Britsch | 240/6.4 CL |
| 2,087,460 | 7/1937 | Wallace | 240/6.4 CL |
| 2,439,496 | 4/1948 | Szantay | 240/10.68 |
| 2,867,753 | 1/1959 | Quandt | 240/6.4 CL X |
| 3,717,759 | 2/1973 | Rousseau | 240/10.68 |
| 3,737,650 | 6/1973 | Kaye et al. | 240/10.68 |

FOREIGN PATENT DOCUMENTS

| | | | |
|---|---|---|---|
| 548,909 | 11/1957 | Canada | 219/268 |
| 1,265,888 | 5/1961 | France | 240/10.6 CH |
| 492,586 | 2/1930 | Germany | 240/6.4 CL |
| 676,209 | 5/1939 | Germany | 240/6.4 CL |
| 948,562 | 9/1956 | Germany | 219/268 |
| 237,832 | 12/1945 | Switzerland | 219/268 |

*Primary Examiner*—L. T. Hix
*Assistant Examiner*—Alan Mathews

[57] ABSTRACT

A multi-purpose cigarette lighter using rechargeable Ni-Cd batteries which comprises a heated coil cigarette lighter for general smoking purpose and which further incorporates an electric lamp. The cigarette lighter includes two housings connected by a spacer member with switches located in the spacer member for both the heating element and the electric lamp.

1 Claim, 18 Drawing Figures

PORTABLE, MULTI-PURPOSE, RECHARGEABLE CIGARETTE LIGHTER

BACKGROUND OF THE INVENTION

1. Field of the Invention

This invention relates to a multi-purpose cigarette lighter and, more particularly, to a portable cigarette lighter which has a coiled wire heated by rechargeable nickel-cadmium battery cells located in the body of the lighter and which is further provided with a built-in vacuum cleaner operated by said cells to work as a table cleaner, and/or with an emergency electric lamp.

2. Description of the Prior Art

The known battery-operated cigarette lighter using an electrically heated wire are of the type that ignites an inflammable gas or which utilizes a very powerful source of electricity such as a car cigarette lighter. Except for these special types, common battery-operated cigarette lighters using an electrically heated wire have been considered to be very uneconomical, because of the short life of the battery, rapidly discharged by the frequent use as well as by the relatively long time required for properly lighting of a cigarette. Furthermore, it has been considered heretofore to be very impracticable to produce a table cigarette lighter using batteries, because of the small size required and therefore of the limitation on the number of small batteries. Recently, however, the nickel-cadmium dry battery cell, for instance General Electric Company's Ni-Cd dry cell "2/3 AA", has been developed, which is small in size, has low internal resistance, affords a large discharge current (current outputs of as much as several amperes), presents small voltage drops in the initial discharge period, and can be rapidly re-charged in a manner of minutes. This makes it possible and practicable to produce a table-model or portable battery-operated multi-purpose cigarette lighter.

Because of the availability of such dry battery cells, it has now become possible to make not only a simple cigarette lighter, but also to incorporate therewith a vacuum cleaner and/or an emergency electric lamp.

SUMMARY OF THE INVENTION

An object of the present invention is to provide an electrically heated, portable cigarette lighter using rechargeable dry battery cells.

It is another object of the invention to provide a cigarette lighter which employs nickel-cadmium dry battery cells of low internal resistance and large discharge current.

It is a further object of the invention to provide a portable cigarette lighter which is equipped with an emergency electric lamp positioned in the upper or lower part of the housing.

Still another object of the invention is to provide a convenient and handy cigarette lighter which is equipped with a miniaturized vacuum cleaner for table use.

These and other objects and advantages of the present invention will become apparent from the following detailed description of the embodiments thereof, with reference to the accompanying drawings.

BRIEF DECRIPTION OF THE DRAWINGS

DETAILED DESCRIPTION OF THE EMBODIMENTS

Figure 1:
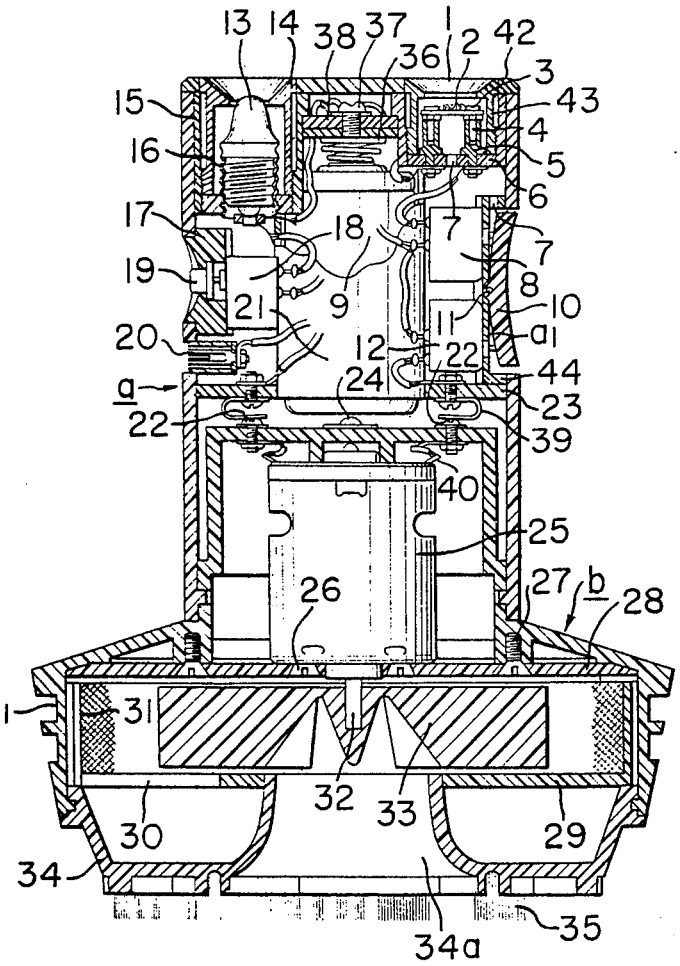
FIG. 1 is a side elevational view, in cross-section, of a combination cigarette lighter — flash-light — vacuum cleaner in accordance with the invention.

Referring now to FIGS. 1–5 the combination cigarette lighter-flashlight — vacuum cleaner will be described. The device has an upper substantially cylindrical outer housing *a* for the lighter-flashlight components. Housing *a* has suitably positioned on its outer portion, for instance on a side surface, a recess *a'* for receiving a switch lever 10 to be later described. An opening 1 is provided in the upper surface of the housing *a* for easy insertion of a cigarette. The cigarette is ignited by contacting it with an electrically heated wire 2 enclosed within a heater 3 and connected to a heater plug 4, a heater socket 5 having at least two slots (not shown clearly) for insertion therein of said plug 4. A plate 6 is supporting the socket 5, while a ventilation aperture 7 allows the circulation of air through the gap around the switch lever 10 and the switch holder 44 (to be later described). A pair of quickly re-chargeable dry battery cells 9 complete this portion of the multi-purpose device, the arrangement being such that when the wire 2 is heated to red heat by the cells, a cigarette may be readily lit by inserting it directly into opening 1. In the recessed portion *a'* of the housing *a* there is provided a switch lever 10 which is held by a holder 44 and is supported by a pivot 11, so that by pressing the upper part of said lever 10 a switch 8 is activated for heating the wire 2, while, on the other hand, by pressing the lower part of the lever 10 the vacuum cleaner switch 12 is activated for energizing a small motor 25 to be later described.

The upper housing *a* contains also a flashlight bulb 13 within a lamp case 14 and having a lamp case cover 15. A lamp socket 16, a lamp switch holder 17 and a lamp switch 18 complete this portion of the multi-purpose device. A push button 19 serves the lamp switch, so that when pressed the lamp switch 18 is activated and the lamp 13 is lit for illumination.

A socket 20 charges the cells 9 so that by inserting the plug into a source of power and connecting to to socket 20, it is possible to recharge the cells. Cells 9 are housed in a cell housing 21 in such a way that the two individual cells are connected in series, with the negative electrode of one cell short-circuited to the positive electrode of the other cell by means of a short circuiting terminal 24. This short circuiting terminal is electrically insulated from other parts of the device.

Figure 3:
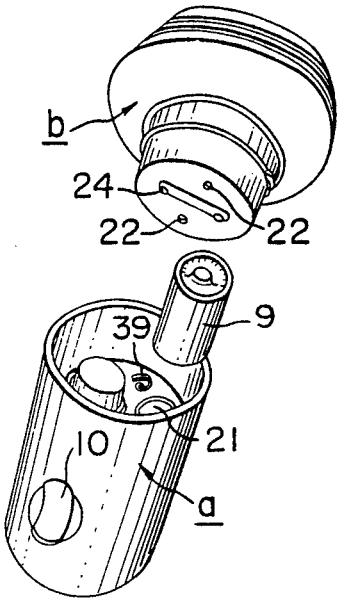
FIG. 3 is a partially exploded, upsidedown perspective view showing the relation of the housing, the cells, and the vacuum cleaner.

A lateral connecting terminal 22 for the vacuum cleaner motor 25, an intermediate wiring element 23 and a short-circuiting terminal 24 for the cells 9 will be described later with reference to FIG. 3. The vacuum cleaner motor 25 is secured by a screw 26 to the motor supporting plate 28 which is fixed to the cleaner's housing *b* by means of screws 27. As stated before, when the cleaner switch 12 is activated, the motor 25 will rotate. Housing *b* for the vacuum cleaner is provided with an exhaust opening *b'* (not seen in FIG. 1 and FIG. 6 but seen in FIG. 5) at its outer periphery and a filter frame 29 having a filter 31 set in its peripheral inner wall. As seen more clearly in FIG. 5, the filter frame 29 is provided with a dust aperture 30 in the outer portion of its bottom surface and is also provided with an exhaust slit 41 in a more central portion of its bottom surface.

A fan 33 is press-fixed to the motor shaft 32 so that it may be rotationally driven within the space defined by said filter frame 29. A dust pan 34 is provided which has a suction opening 34*a* formed in its central region. The dust pan 34 is also provided with brushes 35. The relationship between the se elements can be seen clearly in the exploded perspective view of FIG. 5. It will be understood that the dust pan 34 may be removably attached to the cleaner housing *b* by a bayonet-type insertion and the filter frame 29 is fitted in the cleaner section *b'* and held therein by the dust pan 34.

Ashes, bread crumbs, dust, etc., which are gathered by the brushes 35 by means of the rotation of the fan 33 driven by motor 25, are sucked in together with air through the central suction opening 34*a.*

Figure 5:
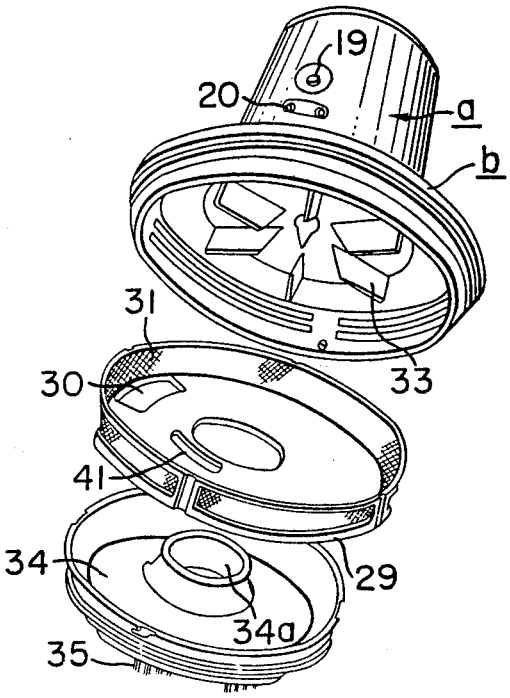
FIG. 5 is an exploded perspective view showing the components of the cleaner-section of the device.

The air sucked in is discharged to the outside through the filter 31 disposed on the filter frame 29, while the ashes, dust, etc., are led through the aperture 30 to the inside of the dust pan 34 and the air in the dust pan 34 is discharged through the discharge slit 41 (FIG. 5).

Referring again to the upper part of FIG. 1, coil springs 36 are utilized for pressing down on the cells 9, the output terminals 37 of which are supported by a plate 38. In the right-hand central portion of FIG. 1 there is shown a spring plate 39 for connecting the cells output terminals 37 to the motor side terminal 22. The input terminal of the motor 25 is indicated at 40. The upper housing *a* is enclosed by the cover plate 42, while heating coils for the cigarette lighter are encased by cover 43.

Figure 2:
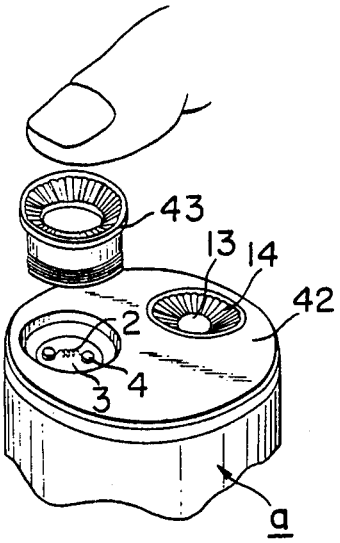
FIG. 2 is a partially exploded perspective view of the upper portion of the cigarette lighter of FIG. 1.

As shown in FIG. 2, the heater cover 43 is detachably fitted to the heater 3 and is therefore readily cleanable.

Figure 4:
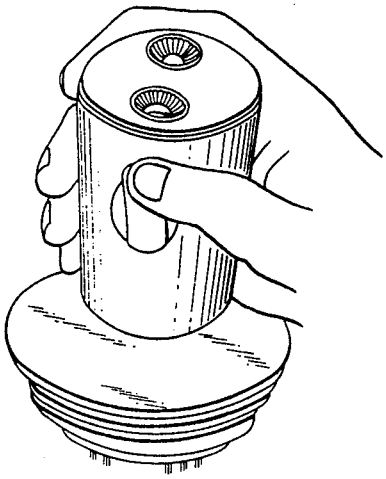
FIG. 4 shows pictorially how the upper elements of the combination are used.

With the above mentioned construction, the cigarette lighter of the invention may normally be placed on a table with the brushes 35 resting on the table surface as it can be seen from FIG. 4. From this figure one can see that one may grasp the housing *a* of the device with one hand and press the upper part of the switch lever 10 with his thumb to activate the switch 8. Then the heating wire 2 will be energized with a current of 2 or 3 amperes, thereby heating the wire 2 red-hot to light a cigarette. It is also understood that when the lower part of the switch lever 10 is pressed with the thumb to activate the switch 12, the motor 25 will be caused to become energized and to rotate by means of the spring plate 39 connected to the cells 9. Then, the brushes 35 may be brought in contact with ashes, dust, etc. on the table and these will be sucked into the dust pan 34.

Instead of pressing the switch lever 10, one may press the lamp switch button 19 which is positioned opposite to the switch lever 10, in order to light the lamp 13 for illumination purposes. As stated before, each of the cells 9 is of small size and high power, has an internal resistance low enough to supply a load of several amperes. Re-charging of the cells can be effected in a short time, generally of the order of minutes, merely by inserting a suitable plug into the socket 20. Usually there is provided a gas discharge valve for safely controlling the discharge of gas during the time of recharging.

Conversely, the conventional common nickel-cadmium cells require a charging time of the order of hours and therefore are not adequate for use in a table cigarette lighter equipped with a vacuum cleaner, such as that of the present invention; even less if the lighter is intended to serve also as an illuminating means, because the requirement of a long charging interval would nullify the convenience of the entire device.

Figure 6:
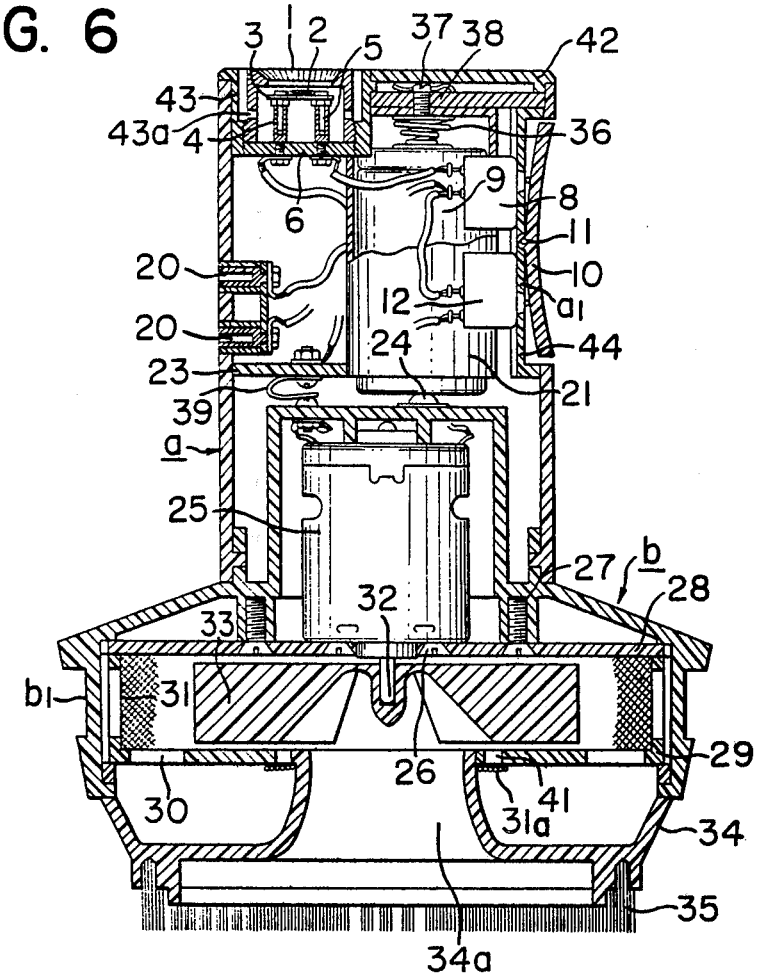
FIG. 6 is a side elevational view, in cross-section, of a variant in which the flash-light component shown in FIG. 1 is omitted.

FIG. 6 shows another embodiment combining a vacuum cleaner and a cigarette lighter the light bulb, such as shown in FIG. 1, being omitted. The difference between this embodiment and that shown in FIG. 1 lies in the omission, for the purpose of simplication, of the components related to illumination, namely the bulb 13, the lamp housing 14, the lamp cover 15, the lamp socket 16, the lamp switch holder 17, the lamp switch 18, and the lamp switch push button 19. However, there is provided the addition of filters 31*a* at the discharge slit 41, and of ventilation apertures 43*a* in the peripheral portion of the case cover 43.

Figure 7:
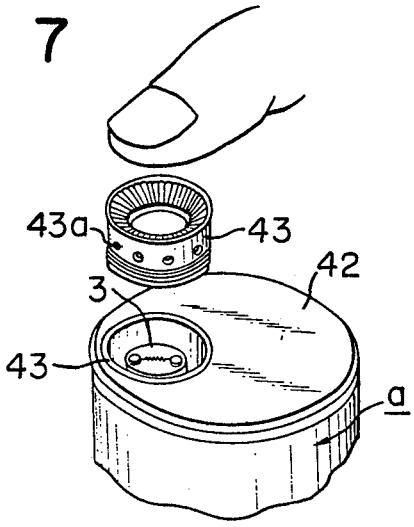
FIG. 7 is a partially exploded perspective view of the top of FIG. 6.

FIG. 7, similarly to FIG. 2, shows the ease of removing the case cover of the cigarette lighter component of the device for purpose of cleaning this part of the multipurpose device.

Figure 8:
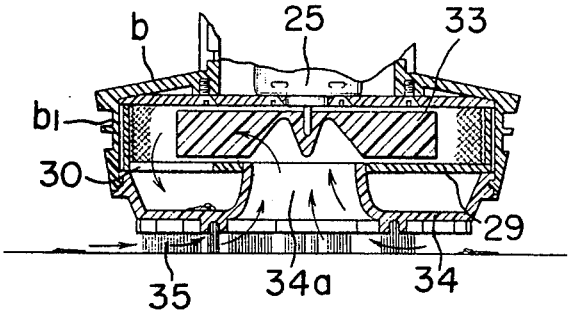
FIG. 8 is a side elevational view, in cross-section, of a variant embodiment of the vacuum-cleaner section of FIG. 6.
Figure 10:
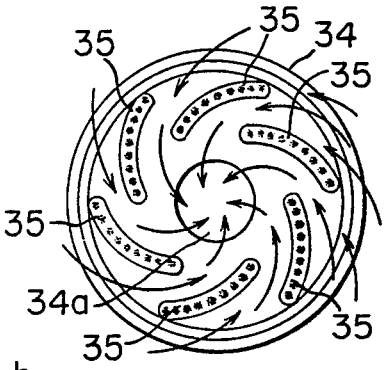
FIG. 10 is a bottom view showing the brushes of the vacuum cleaner of FIG. 8.
Figure 9:
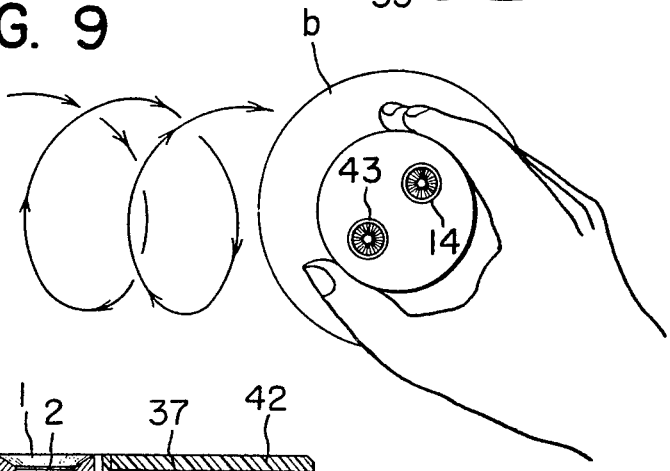
FIG. 9 is an explanatory picture showing the operation of the vacuum cleaner of FIG. 8 on a table.

FIGS. 8, 9 and 10 show a variant embodiment, in which the brushes of the vacuum cleaner are arranged spirally and are spaced from one other in order to enhance the suction efficiency of the vacuum cleaner illustrated in FIG. 1 or FIG. 6. In FIG. 8 the upper structure of the device is omitted since they are the same as in previous Figures. Thus, in this embodiment the focus is on the particular brushing arrangement by which not only dust, ashes, bread crumbs and the like may be removed from the table, but also dust embedded in the table cloth may be sucked up spirally with the suction air without causing resistance to the air stream.

FIG. 8 shows the flow of air produced by the rotation of the fan 33, and FIG. 9 shows a convenient way of sliding the cleaner on a table. It is apparent from the above that sufficient consideration is given to the arrangement of the brushes 35 which located on the lower surface of the dust pan 34, as shown in FIG. 10. A plurality of brush arrays 35 are arranged spirally and spaced from one another in the form of arcs curved in the same direction and extending from the periphery toward the central suction opening 34*a* of the dustpan 34. By contacting a table cloth with the brush arrays so arranged, the dust particles will be stirred up and while bigger particles will be drawn toward the central suction opening 34*a* through the spaces between the brush arrays where no brushes are present, smaller particles will be drawn toward the central suction opening 34*a* not only through the same spaces but also through the spaces between the individual bristles of each brush array. The spiral suction of the air stream caused by the fan 33 is directed toward the central suction opening 34*a* through the spaces between the arcuated brush arrays in the direction of the arrows shown in FIG. 10 without resistance and dust agitation. Therefore even dust which is embedded in the table cloth will be sucked up spirally and drawn to the central suction opening 34*a* according to the same principle operating in a windspout. It has been customary to arrange the brushes of a cleaner in concentric circles surrounding the central suction opening. However, though the suction effect by the brushes may be still available, there is the disadvantage that the pressure in the space defined by the table surface and the central suction opening will be reduced because of the brushes being densely arranged along the circle, so that the dust will be forced to stick even more to the table cloth.

Figure 11:
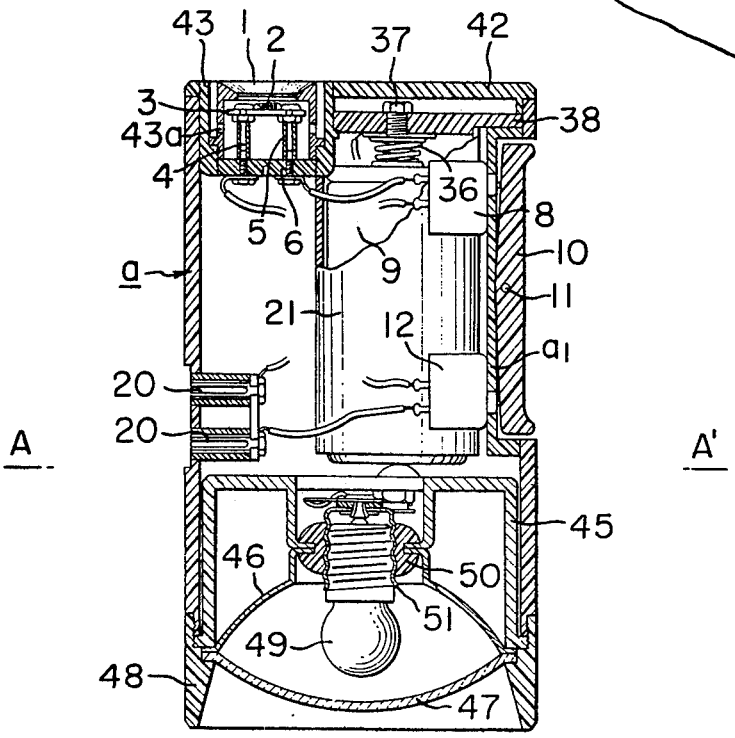
FIG. 11 is a side elevational view in cross-section, of a cigarette lighter combined with an emergency electric lamp.
Figure 12:
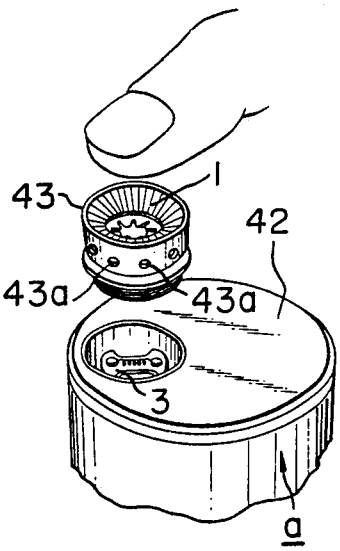
FIG. 12 is a partially exploded perspective view of the top of FIG. 11.
Figure 13:
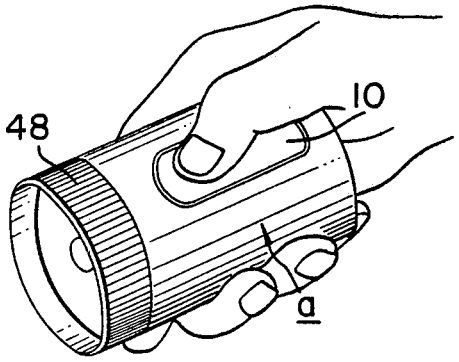
FIG. 13 is a perspective view showing the operation of the emergency lamp.

FIGS. 11, 12 and 13 show still another embodiment of the invention, which provides a table cigarette lighter usable also as a portable emergency lamp readily available in unexpected power failures since the table lighter is usually placed on a table and is readily available.

FIG. 11, the portion above the line A—A', that is, the cigarette lighter portion of the device, will not be described in detail since it was described with reference to FIG. 6. Referring to the portion below line A–A', a lamp socket casing 45 contains a reflector 46, a glass refractor 47 and a cover glass holder 48. The lamp casing 45 is fitted in the lower end portion of the device housing *a*, with the reflector 46 positioned in front of it and the glass refractor 47 placed in front of the reflector. These are held in position by the cover glass holder 48 threaded on the housing *a*. A lamp 49 with a lamp socket holder 50, a lamp socket 51 and a lamp switch 12 complete the arrangement. When the switch 8 of the cigarette lighter is pressed and activated the heater 2 will be energized in the same way as in FIG. 6 and, conversely, when the lamp switch 12 is pressed, the lamp 49 will be energized for illumination purposes. FIG. 13 shows illustratively the operation of the lamp, while FIG. 12, similarly to FIG. 7, shows the cleaning operation of the lighter cover.

Figure 14:
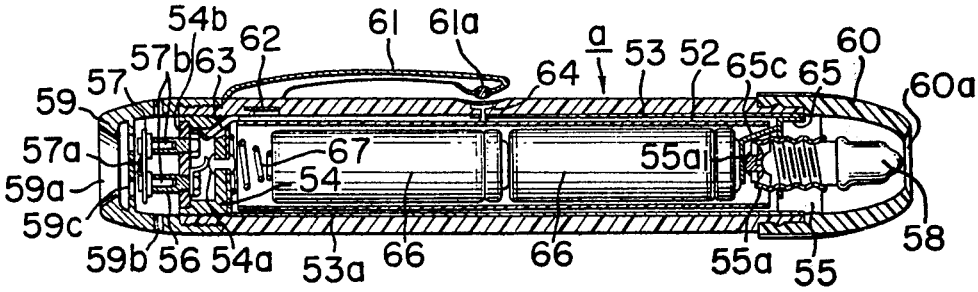
FIG. 14 is a side elevational view, in cross-section, of a lighter-flashlight pocket combination.
Figure 15:
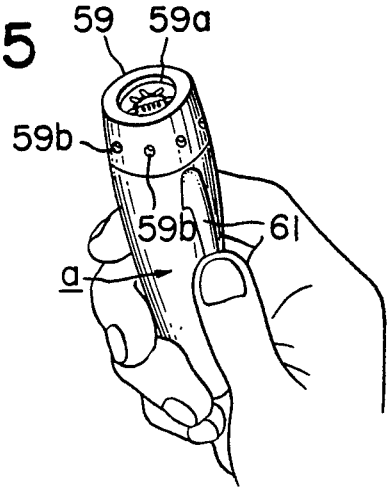
FIG. 15 is a perspective illustration showing the operation of the device of FIG. 14.
Figure 16:
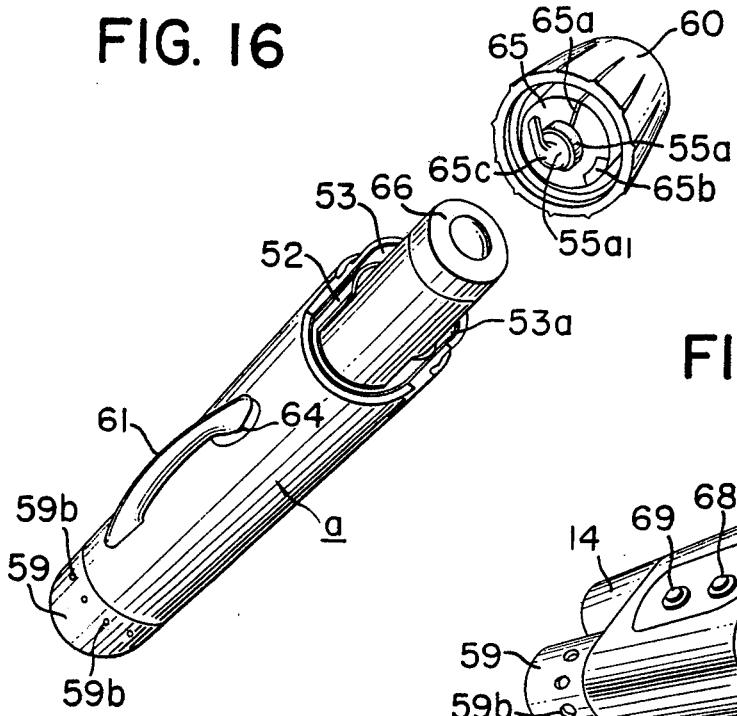
FIG. 16 is a perspective view of FIG. 14 showing the housing partially broken away, and with the lamp cover detached.

FIGS. 14, 15 and 16 show a pencil type cigarette lighter useful also as a portable flash light, thus constituting a modification of the embodiment shown in FIG. 11.

The shaping of this arrangement resembles a pencil or fountain pen which may be clipped on a pocket, the clip serving also as the switch lever to operate the cigarette lighter when depressed, thus eliminating the necessity of additional switches. When it is not in use, the switch is prevented from being activated and the electrical circuit is opened by merely clipping the pencil lighter to one's pocket.

In the figure, the housing *a* is assuming an elongated cylinder configuration; in other words, the shape of a pencil, within which there is housed a battery holding cylinder 52 of an electrically insulating material. Inside the housing *a* but outside the battery holding cylinder 52 there are provided two conducting plates 53 and 53*a* to be used for wiring. A heater socket holder 54 with a terminal 54*a* and a mounting plate 54*b*, and a lamp socket holder 55 with a socket 55*a* complete this assembly. The heater socket holder 54 is threaded in the upper portion of the housing *a* and the lamp socket holder 55 is fitted in the lower part of the housing *a*. On the plate 54*b* there are mounted two sockets 56, which have at least two slots each (not shown). A heater 57 comprises an electric heating wire 57*a* and two plugs 57*b*, which plugs are removably fitted in said socket 56 in such a manner that their fitting and electrical connection is resiliently retained by means of the slotted sockets 56.

A bulb 58 is threaded in the lamp socket 55*a* which is provided with a terminal 55*a*'. A heater cover 59 is provided with a cigarette insertion opening 59*a* at the top and ventilation apertures 59*b* at the periphery thereof, while a bulb cover 60 is employed having an opening for projection of light at the top thereof. The heater cover 59 is threaded onto the upper portion of the housing *a*, whereas the bulb cover 60 is threaded on said lamp socket holder 55 and mounted rotatably on the lower part of the housing *a*. A clip-and-switch lever 61 with a contact 61*a* is itself made of an electrically conducting material (such as hard brass, for example) and fixed at its base end to the housing *a* and connected with an electrically conducting member 62, which is in turn connected to socket 56 through a conducting wire 63. A contact 64 is provided on one end of said conducting plate 53 and faces the contact 61*a* of said clip-and-switch lever 61.

Furthermore, a switch plate 65 is fixed to the above-mentioned lamp socket holder 55. This switch plate 65 is divided into right and left side halves, isolated from each other by slits 65*a*, and is provided at one end with an insulating portion 65*b* and at the other end with a connecting member 65*c* to contact the lamp terminal 55*a*. The insulating portion 65*b* mentioned above is so designed as to make and break contact with the conducting plate 53*a*. A fast re-chargeable battery 66 of the type described in connection with FIG. 1 has the negative electrode constituted by the bottom and by circumferential surfaces thereof and is positioned in the battery housing cylinder 52. A coil spring 67 and a heater guard 59*c* complete the assembly.

With such an arrangement, by pressing the clip-and-switch lever 61 and bringing member 61*a* into contact with the contact coil 64 the heating wire 57*a* of the heater 57 is energized and by rotating the lamp casing 60 clockwise or anticlockwise the lamp 58 will be turned on or off. Replacement of the cell 66 may be achieved by removing the lamp casing 60, which concurrently causes the lamp socket holder 55 to be detached together with lamp casing 60. It is also possible to take the plug 57*b* of the lighter 57 out of the socket 56 in order to clean the heating wire 57*a* and the heater cover 59.

FIGS. 15 and 16 need not detailed explanation after the detailed description given hereabove in connection with FIG. 14.

Figure 18:
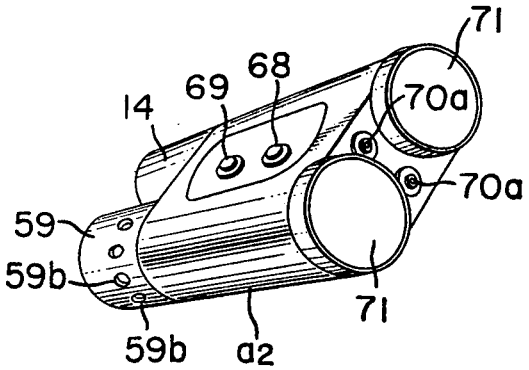
FIG. 18 shows in perspective the positioning of the cells for the device of FIG. 17.
Figure 17:
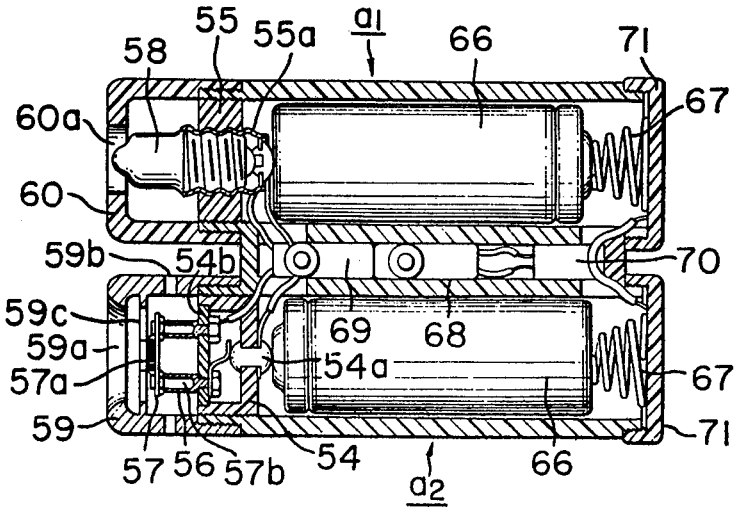
FIG. 17 is a cross-sectional view of another variant of a cigarette lighter-flashlight combination.

FIGS. 17 and 18 show a double casing-type cigarette lighter and portable lamp combination which constitutes a modification of the embodiment shown in FIGS. 14–16.

This embodiment is the same as the pencil type embodiment shown in FIGS. 14–16, with the following exceptions: housing is divided into two parts *a*1 and *a*2; the lamp switch 68 and the lighter switch 69 are positioned inserted in the connecting part between the housing parts *a*1 and *a*2; the charging socket 70 and the socket terminals 70*a* are also arranged inserted in the connecting part; and the back covers 71 for cells 66 are provided on the housing parts *a*1, *a*2. The use of reference numerals is furthermore also consistent with FIGS. 14–16, except for those related to the above-mentioned elements. The operation of this combination is the same as described above.

This variant embodiment is convenient for portable use since it is generally compact and similar to the usual boxshaped cigarette lighters. The provision of the charging socket 70 with its socket terminals 70*a* makes it possible to re-charge the cells 66 as they are held in the housing by simply connecting a re-charger to the socket terminals.

Numerous other changes and variations may be made in the above described inventive device without ever departing from the spirit of the invention. It is intended that all matter contained in the foregoing description and in the accompanying drawings shall be interpreted as illustrative and not in a limiting sense.

What is claimed is:

1. A portable cigarette lighter comprising laterally spaced apart first and second, side-by-side housing means defining a volume, each of said housing means being adapted to contain a rechargable battery cell, spacer means interconnecting said first and second housing means, a heating element in one of said housing means, an illuminating lamp in the other of said housing means, separate switch means for said heating element and said illuminating lamp, said switch means being located in said spacer means, and socket means in said spacer means, said socket means being electrically coupled to terminal means in said spacer means and adapted to be connected to a source of current for recharging the battery cells.

* * * * *